US006749137B2

(12) United States Patent
Kato et al.

(10) Patent No.: US 6,749,137 B2
(45) Date of Patent: Jun. 15, 2004

(54) ELECTROMAGNETIC FUEL INJECTION VALVE

(75) Inventors: Yukinori Kato, Obu (JP); Motoyuki Suzuki, Obu (JP); Hikaru Kikuta, Obu (JP); Tomohiro Okubo, Obu (JP); Masami Hirata, Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 10/391,654

(22) Filed: Mar. 19, 2003

(65) Prior Publication Data

US 2003/0178510 A1 Sep. 25, 2003

(30) Foreign Application Priority Data

Mar. 22, 2002 (JP) ..... 2002-079891

(51) Int. Cl.[7] ..... F02M 51/00

(52) U.S. Cl. ..... 239/585.1; 239/585.2; 239/585.3; 239/585.4; 239/585.5; 239/900; 239/533.11

(58) Field of Search ..... 239/585.1, 585.2, 239/585.3, 585.4, 585.5, 900, DIG. 19, 533.11

(56) References Cited

U.S. PATENT DOCUMENTS 5,769,391 A * 6/1998 Noller et al. ..... 239/585.4
6,003,791 A * 12/1999 Reiter ..... 239/575
6,079,642 A * 6/2000 Maier ..... 239/585.1
6,494,389 B1 * 12/2002 Reiter ..... 239/585.1
2001/0015418 A1 * 8/2001 Reiter ..... 239/585.1
2003/0116655 A1 * 6/2003 Reiter ..... 239/585.1

FOREIGN PATENT DOCUMENTS

JP 11500509 1/1999
JP 11200979 7/1999

* cited by examiner

*Primary Examiner*—Robin O. Evans
(74) *Attorney, Agent, or Firm*—Baker Botts L.L.P.

(57) ABSTRACT

An electromagnetic fuel injection valve wherein a central pipe part has satisfactory mechanical strength and an intermediate portion of the pipe part is surely made non-magnetic is provided. The electromagnetic fuel injection valve has a core surrounded by a solenoid coil. A valve housing is disposed forward of the core. The core and the valve housing are connected through a thin-walled portion. The wall thickness of the thin-walled portion is smaller than the wall thickness of the core and that of the valve housing. The core and the thin-walled portion, together with the valve housing, are formed in an integral structure. The thin-walled portion has a sufficient wall thickness to provide satisfactory mechanical strength. The thin-walled portion is modified into a high-hardness non-magnetic portion by a carbulizing treatment.

3 Claims, 2 Drawing Sheets

ELECTROMAGNETIC FUEL INJECTION VALVE

BACKGROUND OF THE INVENTION

1. Field of the Invention

The present invention relates to an electromagnetic fuel injection valve for use, for example, in an engine for a vehicle.

2. Discussion of Related Art

FIG. 2A shows a first example of conventional electromagnetic fuel injection valves [see Japanese Patent Application Unexamined Publication (KOKAI) No. Hei 11-200979]. The electromagnetic fuel injection valve has a cylindrical ferromagnetic valve housing 1 at the front end thereof (the lower end in FIG. 2A). A front half of a ring-shaped, non-magnetic intermediate member 2 is press-fit and welded to the rear end portion of the valve housing 1 (the upper end portion in FIG. 2A). A front end portion of a hollow shaft-shaped, ferromagnetic core 3 is press-fit and welded to a rear half of the intermediate member 2. The core 3 has a flange 3A projecting radially outward from approximately the axial center thereof. A bobbin 4 is molded from a synthetic resin material on the outer periphery of the joint between the intermediate member 2 and the core 3. The bobbin 4 is wound with a solenoid coil 6. A terminal mounting portion 4A is formed on the rear end portion of the bobbin 4. A connecting end portion 5A of a terminal 5 is connected to the terminal mounting portion 4A.

The outer peripheral portion of the solenoid coil 6 is partially surrounded by extending pieces 7A of a ferromagnetic outer magnetic path forming member 7. The outer magnetic path forming member 7 has an upper end plate portion with a mounting hole 8 formed in the center thereof. A pair of extending pieces 7A with an arcuate sectional configuration extend forwardly from the upper end plate portion. The mounting hole 8 of the outer magnetic path forming member 7 is fitted with the core 3 in such a manner that the upper end plate portion is adjacent to the rear surface of the flange 3A. The front end portions of the extending pieces 7A of the outer magnetic path forming member 7 are secured to the valve housing 1 by welding. A resin molded portion 12 is formed on the outer periphery of a portion extending from the rear half of the valve housing 1 to the rear end portion of the core 3. The resin molded portion 12 includes a connector 9, which is molded simultaneously.

An armature 22 formed by a rear end portion of a moving member 20 is slidably fitted inside the rear portion of the valve housing 1 and the front half of the intermediate member 2. The moving member 20 is a hollow member having a reduced-diameter cylindrical portion 20A formed forward of and adjacent to the armature 22. A ball valve (valving element) 23 is secured to the distal end of the reduced-diameter cylindrical portion 20A. A lateral hole 20B is formed in the front end side wall of the reduced-diameter cylindrical portion 20A. The hollow portion of the moving member 20 and the lateral hole 20B form in combination a fuel passage 24. A valve seat 13 in the shape of a cylinder, one end of which is substantially closed, is inserted into and secured to the front end portion of the valve housing 1. An injection port 15 is formed in the front end wall of the valve seat 13. An orifice plate 14 is welded to the front end surface of the valve seat 13. The orifice plate 14 has a plurality of injection holes 14A formed in the center thereof. The ball valve 23 and the valve seat 13 constitute in combination an injection valve. The injection valve is opened or closed by axial movement of the moving member 20.

The armature 22 has a stepped surface 25 formed on the inner surface thereof. An adjuster 17 is press-fit in the core 3. A valve spring 16 is fitted between the front end of the adjuster 17 and the stepped surface 25 of the armature 22. The valve spring 16 urges the moving member 20 in the valve closing direction. A series of portions of fuel passage 18 (including the fuel passage 24) is formed by the inside space between the rear end opening of the core 3 and the injection port 15 of the valve seat 13. A strainer 19 is fitted in the rear end portion of the core 3. An O-ring 11 is fitted in an annular groove 10 on the outer peripheral surface of the rear end portion of the resin molded core 3.

Next, the operation of the first conventional example will be described. Pressurized fuel is filtered through the strainer 19 and then supplied to the inside of the valve seat 13 through the fuel passages 18. An electric signal is input through the terminal 5 and the connecting end portion 5A to initiate the supply of electric power to the solenoid coil 6. Consequently, a magnetic flux is created around the solenoid coil 6. The magnetic flux flows through a magnetic circuit surrounding the solenoid coil 6. The magnetic circuit is formed by the outer magnetic path forming member 7, the core 3, the armature 22 and the valve housing 1. The intermediate member 2 functions to prevent short-circuiting of the magnetic flux between the core 3 and the valve housing 1. When the magnetic flux flows through the magnetic circuit, magnetic attractive force is produced between the core 3 and the armature 22. The magnetic attractive force attracts the armature 22 toward the core 3, causing the ball valve 23 to open the injection port 15. Consequently, fuel is injected from the injection port 15. The injected fuel is sprayed through the injection holes 14A of the orifice plate 14. When the supply of electric power to the solenoid coil 6 is cut off and hence the attractive force acting on the armature 22 is canceled, the moving member 20, together with the ball valve 23, is advanced by the urging force of the valve spring 16. Thus, the ball valve 23 closes the injection port 15 to stop the injection of fuel from the injection port 15.

The electromagnetic fuel injection valve needs to provide a non-magnetic portion in the central pipe part to activate the ball valve. In the first conventional example, the ferromagnetic core 3, the non-magnetic intermediate member 2 and the ferromagnetic valve housing 1 are welded together to secure the members and to prevent leakage of fuel. However, welding requires a great deal of labor and cost. In addition, welding involves a danger of thermal deformation. To avoid the disadvantages of welding, the following second conventional example was proposed (see Published Japanese Translation of PCT International Publication No. Hei 11-500509).

FIG. 2B shows an essential part of the second conventional example. In the second conventional example, the central pipe part comprises a single pipe 27. The pipe 27 is divided into a core 3, a magnetic restrictor portion 28 and a valve housing 1, which are different in the wall thickness from each other. When the injection valve opens, the lower end surface 29 of the core 3 abuts against the upper end surface 30 of the armature 22. When the injection valve is closed, an air gap (e.g. 60 $\mu$m) is produced between the lower end surface 29 and the upper end surface 30. The magnetic restrictor portion 28 has a very thin wall thickness. For example, the restrictor portion with an axial length of 2 mm has a wall thickness of 0.2 mm. A guide surface 33 is formed on the outer periphery of an upper end portion of the armature 22 at a side thereof facing the restrictor portion 28. A radial air gap 32 (e.g. 80 $\mu$m) is provided at each of the upper and lower sides of the guide surface 33, i.e. between the armature 22 and the restrictor portion 28 and between the armature 22 and the valve housing 1.

The operation of the second conventional example will be described below. When the supply of electric power to the solenoid coil is initiated, a magnetic flux is produced around the solenoid coil. The greater part of the magnetic flux flows through the outer magnetic path forming member (not shown), the core 3, the armature 22 and the valve housing 1, and a small amount of magnetic flux flows through the restrictor portion 28. A little magnetic flux flows from the restrictor portion 28 to the guide surface 33 of the armature 22. In response to the supply of electric power to the solenoid coil, the injection valve opens, and when the supply of electric power is cut off, the injection valve is closed, as in the case of the first conventional example.

SUMMARY OF THE INVENTION

The second conventional example is lower in cost and more excellent in injector performance than the first conventional example because the central pipe part is formed in an integral structure. However, the second conventional example suffers from the following three disadvantages.

(1) Because the restrictor portion (thin-walled portion) has a thin wall thickness, mechanical strength is insufficient.

(2) Because the intermediate portion is a magnetic restrictor, the magnetic characteristics are not stabilized. Consequently, the injector responsivity varies to a considerable extent.

(3) The lower end surface of the core, against which the upper end surface of the armature abuts (i.e. armature abutting surface), should be plated with chromium to prevent wear. However, it is difficult to give chrome plating only to the lower end surface of the core.

An object of the present invention is to provide an electromagnetic fuel injection valve having a central pipe part formed in an integral structure, wherein the thin-walled portion is provided with satisfactory mechanical strength, and the intermediate portion is surely made non-magnetic to improve injector responsivity, and further the armature abutting portion is formed to an appropriate hardness.

The present invention is applied to an electromagnetic fuel injection valve wherein an injection port is opened or closed by a valving element, and an armature is formed at the rear end of a hollow moving member having the valving element secured thereto. A core is surrounded by a solenoid coil. A tubular valve housing is disposed forward of the core. The core and the valve housing are connected through a thin-walled portion. The wall thickness of the thin-walled portion is smaller than the wall thickness of the core and that of the rear half of the valve housing. The core and the thin-walled portion, together with the valve housing, are formed in an integral structure. According the present invention, the thin-walled portion has a sufficient wall thickness to provide satisfactory mechanical strength. The thin-walled portion is modified into a high-hardness non-magnetic portion by a carbulizing treatment.

In the above-described arrangement of the present invention, the carbulizing treatment for the thin-walled portion may be carried out by plasma carbulization. The armature abutting portion at the lower end of the core is hardened by the plasma carbulization.

Preferably, the plasma-carbulized thin-walled portion has a wall thickness of not less than 0.6 mm, and the armature abutting portion has a hardness of not less than HV 450.

In the electromagnetic fuel injection valve according to the present invention, the thin-walled portion has a sufficient wall thickness (e.g. not less than 0.6 mm) to provide satisfactory mechanical strength. In addition, the thin-walled portion is formed into a high-hardness non-magnetic portion by a carbulizing treatment, e.g. plasma carbulization. Therefore, the electromagnetic fuel injection valve exhibits excellent injector responsivity. Further, because the lower end portion (armature abutting portion) of the core has an appropriate hardness (e.g. not less than HV 450) imparted thereto by the carbulizing treatment, the armature abutting portion need not be plated with chromium. Accordingly, costs are reduced.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 1A:
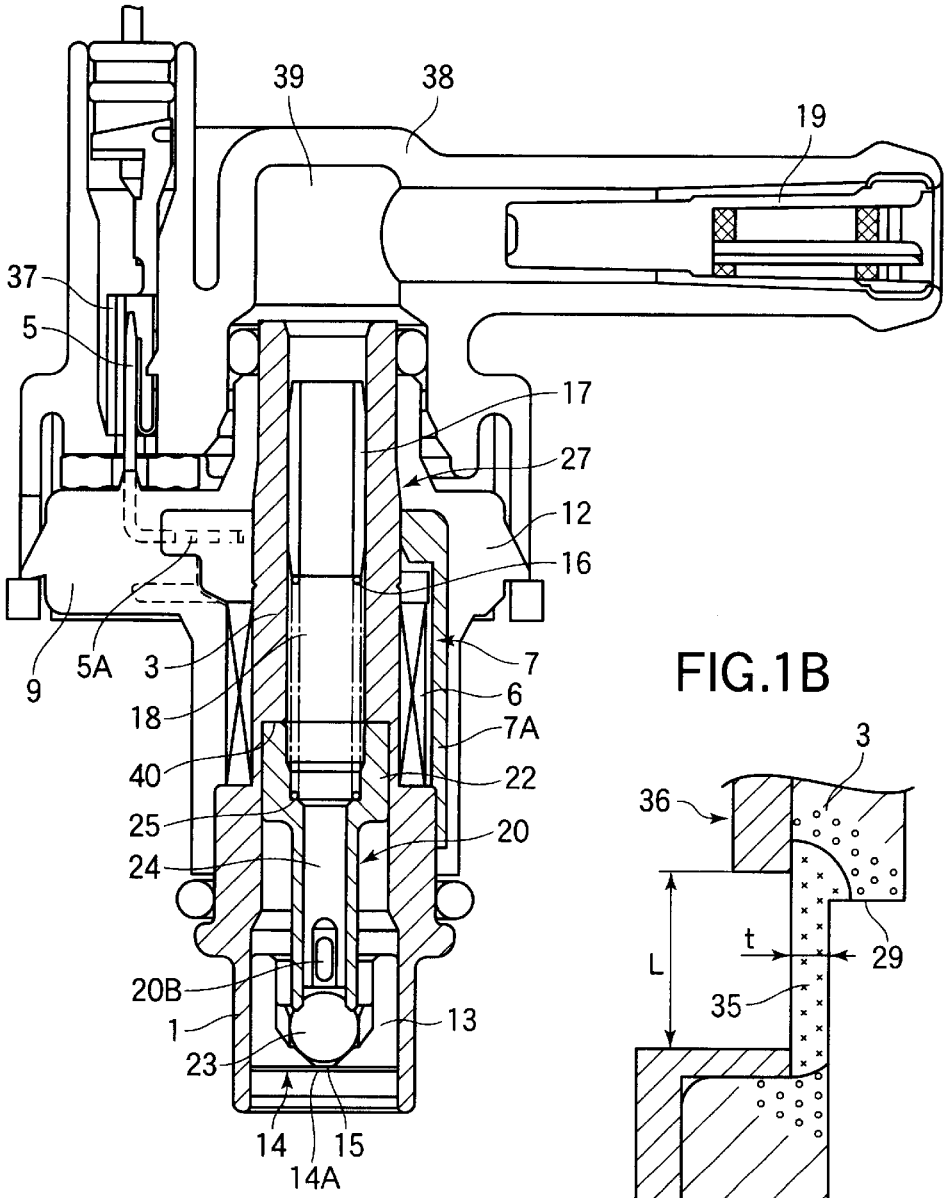
FIG. 1A is a sectional view of an electromagnetic fuel injection valve according to the present invention.
Figure 1B:
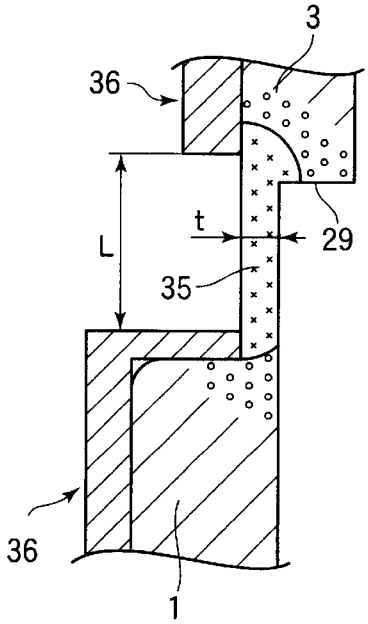
FIG. 1B is an explanatory view of an essential part of FIG. 1A.
Figure 2A:
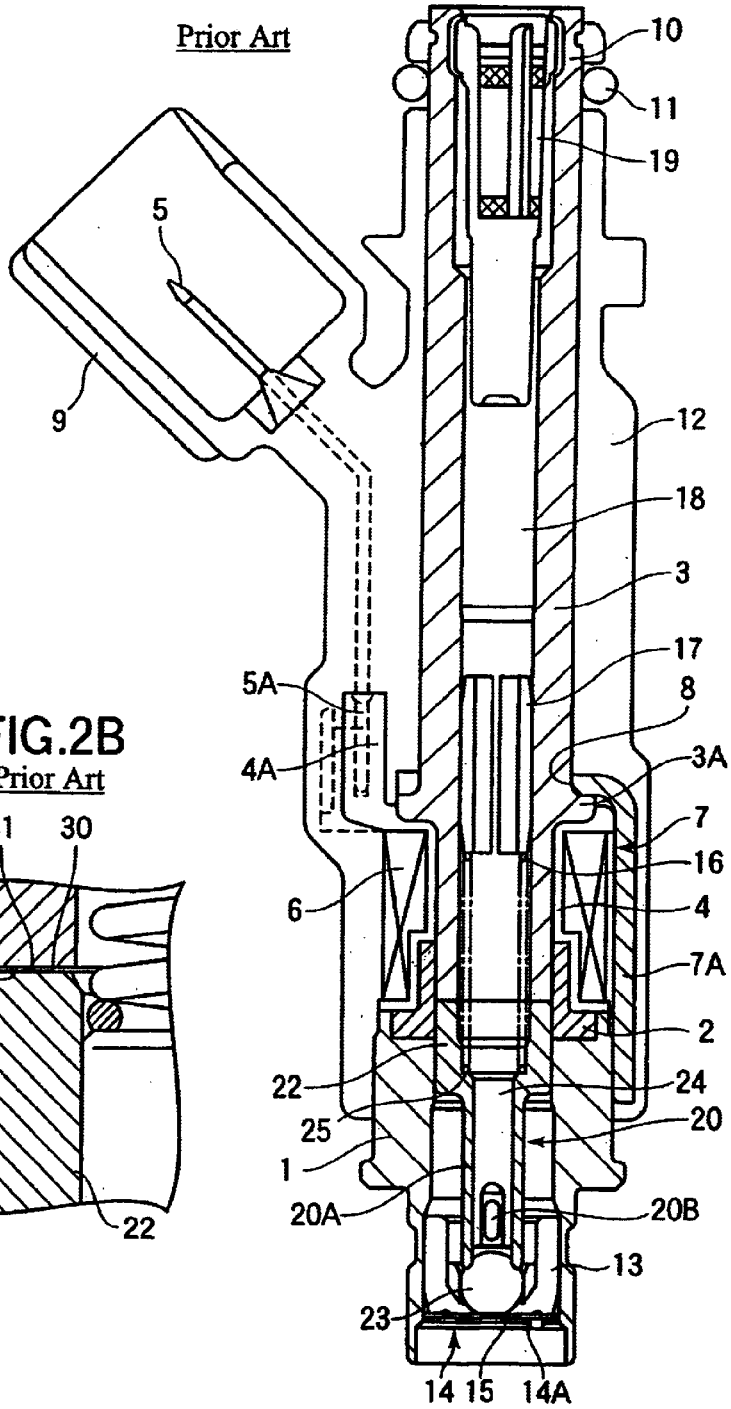
FIG.2A Prior Art
FIG. 2A is a sectional view of a first conventional example.
Figure 2B:
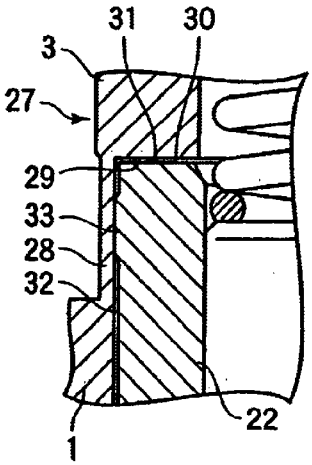
FIG.2B Prior Art
FIG. 2B is a fragmentary sectional view of a second conventional example.

FIGS. 1A and 1B show an embodiment of the present invention. Regarding FIGS. 1A and 1B, the same members as those in FIGS. 2A and 2B are denoted by the same reference symbols as those in FIGS. 2A and 2B, and a description of these members is omitted or given only briefly.

As shown in FIGS. 1A and 1B, the central pipe part comprises a single pipe 27. The constituent material of the pipe 27 is a corrosion-resisting soft magnetic or ferromagnetic stainless steel. The pipe 27 is divided into a core 3, a thin-walled portion 35, and a valve housing 1, which are successively adjacent to each other. The outer diameter of the thin-walled portion 35 is the same as the outer diameter of the core 3. The inner diameter of the thin-walled portion 35 is larger than the inner diameter of the core 3. A step portion 40 defined between the thin-walled portion 35 and the core 3 forms the lower end of the core 3. Further, the inner diameter of the thin-walled portion 35 is the same as the inner diameter of the upper half of the valve housing 1. The thin-walled portion 35 has a sufficient wall thickness t to provide satisfactory mechanical strength (e.g. the wall thickness t is not less than 0.6 mm). The thin-walled portion 35 is modified into a high-hardness non-magnetic portion by a carbulizing treatment.

Plasma carbulization may be carried out as a carbulizing treatment. As shown in FIG. 1B, the outer periphery of the pipe 27 is covered with a masking jig 36 to provide an exposed portion of a predetermined width L (e.g. 2.6 mm) on the outer surface of the thin-walled portion 35. The front end of the exposed portion is slightly rearward of the front end of the thin-walled portion 35, and the rear end of the exposed portion is slightly rearward of the rear end of the thin-walled portion 35. The pipe 27 with the masking jig 36 fixed thereto is put in a propane gas chamber, and a grow discharge is generated in the chamber. The treatment temperature is, for example, from 1000 to 1100° C. The treatment time is, for example, from 2 to 3 hours. The grow discharge in the propane gas produces activated carbon ions. The activated carbon ions collide with the surface of the thin-walled portion 35. Thus, plasma carbulization is performed. By the plasma carbulization, a portion marked with X in FIG. 1B (e.g. a width of from not less than 2.6 mm to not more than 3.0 mm; the whole thin-walled portion 35) is surely modified into a high-hardness non-magnetic portion, and portions marked with ○ in FIG. 1B (a portion at the lower end of the core 3 against which the armature 22 abuts, and so forth) are hardened. The modified portion has been transformed from a magnetic ferrite stainless steel into a non-magnetic austenite stainless steel. In the hardened armature abutting portion, the hardness (Vickers hardness) of the body material, which is HV 200, has changed to not less than HV 450. Thus, the difference in hardness between the abutting surfaces (between the core 3 and the armature 22) is small. The armature abutting surface has an appropriate hardness as an abutting surface. It should be noted that tempering after carbulization is not performed.

In the embodiment of the present invention, a resin molded portion 38 is used, as shown in FIG. 1A. The resin molded portion 38 is connected to the rear end of the resin molded portion 12. The resin molded portion 38 is formed with a fuel passage 39 communicating with the fuel passage 18. The upstream portion of the fuel passage 39 extends in a direction perpendicular to the pipe 27. A connector 37 is inserted into the resin molded portion 38. The front portion of the connector 37 is engaged and connected to the terminal 5. A cord is connected to the rear portion of the connector 37. The arrangement of the rest of the embodiment of the present invention is the same as in the first conventional example.

The operation of the embodiment of the present invention will be described below. When the supply of electric power to the solenoid coil 6 is initiated, a magnetic flux is created around the solenoid coil 6. The magnetic flux flows through a magnetic circuit surrounding the solenoid coil 6. The magnetic circuit is formed by the outer magnetic path forming member 7, the core 3, the armature 22 and the valve housing 1. The non-magnetic thin-walled portion 35 functions to prevent short-circuiting of the magnetic flux between the core 3 and the valve housing 1. When the magnetic flux flows through the magnetic circuit, magnetic attractive force is produced between the core 3 and the armature 22. The armature 22 is attracted toward the core 3 to move rearward, causing the ball valve 23 to open the injection port 15. Thus, the injection valve opens. When the supply of electric power to the solenoid coil 6 is cut off and hence the attractive force acting on the armature 22 is canceled, the moving member 20, together with the ball valve 23, is caused to move forward by the urging force of the valve spring 16. Thus, the injection valve is closed, and hence the injection of fuel from the injection port 15 is stopped.

It should be noted that the present invention is not necessarily limited to the foregoing embodiment but can be modified in a variety of ways without departing from the gist of the present invention.

What is claimed is:

1. An electromagnetic fuel injection valve comprising:

a valving element for opening or closing an injection port;

a hollow moving member having said valving element secured thereto;

an armature formed at a rear end of said hollow moving member;

a core surrounded by a solenoid coil;

a tubular valve housing disposed forward of said core; and a thin-walled portion connecting together said core and said valve housing, said thin-walled portion having a wall thickness smaller than a wall thickness of said core and that of a rear half of said valve housing;

said core, thin-walled portion and valve housing being formed in an integral structure;

wherein said thin-walled portion has a sufficient wall thickness to provide satisfactory mechanical strength, and said thin-walled portion has been modified into a high-hardness non-magnetic portion by a carbulizing treatment.

2. An electromagnetic fuel injection valve according to claim 1, wherein said carbulizing treatment for said thin-walled portion is carried out by plasma carbulization, and an armature abutting portion at a lower end of said core is hardened by said plasma carbulization.

3. An electromagnetic fuel injection valve according to claim 2, wherein said thin-walled portion has a wall thickness of not less than 0.6 mm, and said armature abutting portion has a hardness of not less than HV 450.

* * * * *